US005651306A

United States Patent [19]

Hoshino

[11] Patent Number: 5,651,306

[45] Date of Patent: Jul. 29, 1997

[54] ARCH TYPE STRAPPING MACHINE HAVING AN ADJUSTABLE SPEED BAND TIGHTENING MECHANISM WITH DUAL SPEEDS

[75] Inventor: Tetsuya Hoshino, Yokohama, Japan

[73] Assignee: Nichiro Kogyo Co., Ltd., Yokohama, Japan

[21] Appl. No.: 559,042

[22] Filed: Nov. 15, 1995

[30] Foreign Application Priority Data

Feb. 14, 1995 [JP] Japan ..... 7-047922
Feb. 14, 1995 [JP] Japan ..... 7-047925

[51] Int. Cl.[6] ..... B65B 13/22

[52] U.S. Cl. ..... 100/26; 53/589; 100/32

[58] Field of Search ..... 100/26, 29, 32, 100/33 R, 33 PB; 53/589

[56] References Cited

U.S. PATENT DOCUMENTS 4,020,756 5/1977 Weiss ..... 100/29
4,155,799 5/1979 Matsushita et al. ..... 100/33 PB
4,569,186 2/1986 Mori et al. ..... 100/29
5,155,982 10/1992 Boek et al. ..... 100/29

FOREIGN PATENT DOCUMENTS 5-97115 4/1993 Japan .
1161827 8/1969 United Kingdom ..... 100/26

*Primary Examiner*—Stephen F. Gerrity
*Attorney, Agent, or Firm*—Oblon, Spivak, McClelland, Maier & Neustadt, P.C.

[57] ABSTRACT

A roller unit for controlling band-feeding of an arch-type strapping machine, wherein the high-speed pulling back and strong tightening operations can be efficiently proceeded by reducing friction and impact force between a band and a return roller at the transition time between the high-speed pulling back and the strong tightening. The roller unit is so constructed that a return roller is driven via an one-way clutch, wherein a high-speed return roller of small torque and high speed return roller can be pushed to contact to the upper portion of the return roller and a return rocker roller can be pushed to contact to the lower portion of the return roller.

5 Claims, 9 Drawing Sheets

ARCH TYPE STRAPPING MACHINE HAVING AN ADJUSTABLE SPEED BAND TIGHTENING MECHANISM WITH DUAL SPEEDS

BACKGROUND OF THE INVENTION

1. Field of the Invention

The present invention relates to an improvement in an arch type strapping machine. In particular, it relates to a roller unit for feeding and pulling back a band, whereby the band is fed from a chamber through the roller unit to an arch type band guide, and is wound around an article to be packed and pulled back after its top end portion has been secured between an anvil and a right gripper. It also relates to an improvement in a transmission mechanism of driving force in the arch type strapping machine.

2. Discussion of Background

Roller units for controlling band-feeding in conventional arch type strapping machines are disclosed, for example, in Japanese Examined Patent Publication No.97115/1993. A band was fed to and pulled back from a band guide by a driving roller 37 and a counter roller 38 as in FIGS. 9 and 10. Since operations to the band were carried out with a pair of the rollers 37, 38 as shown in FIG. 9, the band had to be driven by rotating the driving roller 37 in a forward or a rearward direction. Accordingly, a speed control for the roller at the time of pulling back and tightening in succession was complicated, whereby there were various problems such that high speed feeding for efficient operations was difficult and a torque at the time of tightening was not sufficient.

Also, in order to solve such disadvantages, it can be considered to use a driving roller having a larger diameter, by which the speed of the band at the time of feeding and pulling back can be increased. However, since a tightening force applicable to the band is substantially changed depending on a contact position of the counter roller to the large driving roller, the counter roller being in forcibly contact with the driving roller to produce a returning force to the band, an adjustment of tension force was difficult. Further, since it took a certain amount of time to decelerate the large driving roller having a large inertia at the transient time from the first tightening operation to the secondary tightening operation which is much stronger, the band suffered from an impact force. Accordingly, an equipment for controlling the roller unit was complicated.

SUMMARY OF THE INVENTION

It is an object of the present invention to improve the problems of the conventional roller units by providing a roller unit which can be efficient for band feeding at a high speed, first tightening at a high speed and secondly strong tightening at a low speed.

It is another object of the present invention to provide a roller unit which can feed a band to the band guide at a high speed and pull back for the first tightening at a high speed with a small torque.

It is another object of the present invention to avoid a large friction force applied to the band by decelerating a return roller after the pulling-back of the return roller at a high speed.

It is another object of the present invention to reduce a shock applied to the band by decelerating the return roller.

It is another object of the present invention to prevent the band from loosening at the transient time between the first tightening and the secondly tightening.

It is another object of the present invention to reduce the cost for a controlling mechanism and to solve consumption of electric power by simplifying the controlling mechanism of the roller unit.

It is another object of the present invention to achieve the miniaturization of a roller driving device and save consumption of the electric power by the roller driving device by suppressing an excessive friction which occurs between the roller and the band in a period between the first tightening and the secondary tightening.

It is another object of the present invention to provide a driving mechanism with a simple structure which drives a miniaturized roller unit and a group of cams.

The above-mentioned and other objects of the present invention have been attained by providing a strapping machine having a band feeding unit, a roller unit for operating a band, a seal unit, an arch unit and a driving force transmission mechanism, characterized in that the roller unit has a pair of band feeding rollers (37, 38), a return roller of large torque and low speed (39), a return roller of high-speed and small torque (40) provided in an upper portion of the return roller so as to be capable of contacting with or separating from the return roller and a rocker roller for the secondary tightening (41) provided in a lower portion of the return roller so as to be capable of contacting with or separating from the return roller, wherein the band is wound around an article to be packed by feeding the band to a band guide positioned in the arch unit by means of the pair of the band feeding rollers (37, 38); the top end of band is held by an anvil (68) and a right gripper (62); the high-speed return roller (40) is pushed to contact the return roller (39) to cause the first tightening at a high speed; and after the first tightening had been finished, the high-speed return roller (40) is separated from the return roller (39) and simultaneously the rocker roller (41) is pushed to contact the return roller (39) to cause the secondary tightening which is more forcible. In accordance with the present invention, there is provided a strapping machine having a band feeding unit, a roller unit for operating a band, a seal unit, an arch unit and a driving force transmission mechanism, characterized in that the roller unit has a pair of band feeding rollers (37, 38), a return roller of large torque and low speed (39), a return roller of high-speed and small torque (40) provided in an upper portion of the return roller so as to be capable of contacting with or separating from the return roller (39) and a rocker roller for the secondary tightening (41) provided in a lower portion of the return roller so as to be capable of contacting with or separating from the return roller, wherein the high-speed return roller (40) is connected to a motor 31 via an electromagnetic clutch; the band is wound around an article to be packed by feeding the band to a band guide positioned in the arch unit by means of the pair of band feeding rollers (37, 38); the top end of the band is fixed; the high-speed return roller (40) is pushed to contact the return roller (39) to cause the first tightening; after the first tightening has been finished, the electromagnetic clutch is released while the high-speed return roller (40) is pushed to contact the return roller (39); and the rocker roller (41) is pushed to contact the return roller (39) to cause the secondary tightening which is more forcible.

In the above-mentioned inventions, the high-speed return roller (40) and the band feeding roller (37) are driven by a single belt; the high-speed return roller (40) and the band feeding rocker roller (38) are supported by levers (46, 53) in a swingable manner; and the levers are capable of swinging simultaneously by means of a cam 56 fixed to a camshaft of seal unit.

In accordance with the present invention, there is provided a strapping machine comprising a band feeding unit, a roller unit for operating a band, a seal unit, an arch unit and a driving force transmission mechanism, characterized in that a camshaft for driving the seal unit is provided in parallel with the arch unit; a return roller has a driving shaft which is in perpendicular to the arch unit; and in the transmission mechanism of driving force, the camshaft for driving the seal unit and the drive shaft of the return roller which cross perpendicularly each other are coupled to the motor via a speed reduction gear (81) having two output shafts (83, 84) each crossing perpendicularly.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Preferred embodiments of the present invention will now be described in detail with reference to the drawings wherein the same numerical references are used for the same or the similar portions and description of these portions is omitted.

Figure 1:
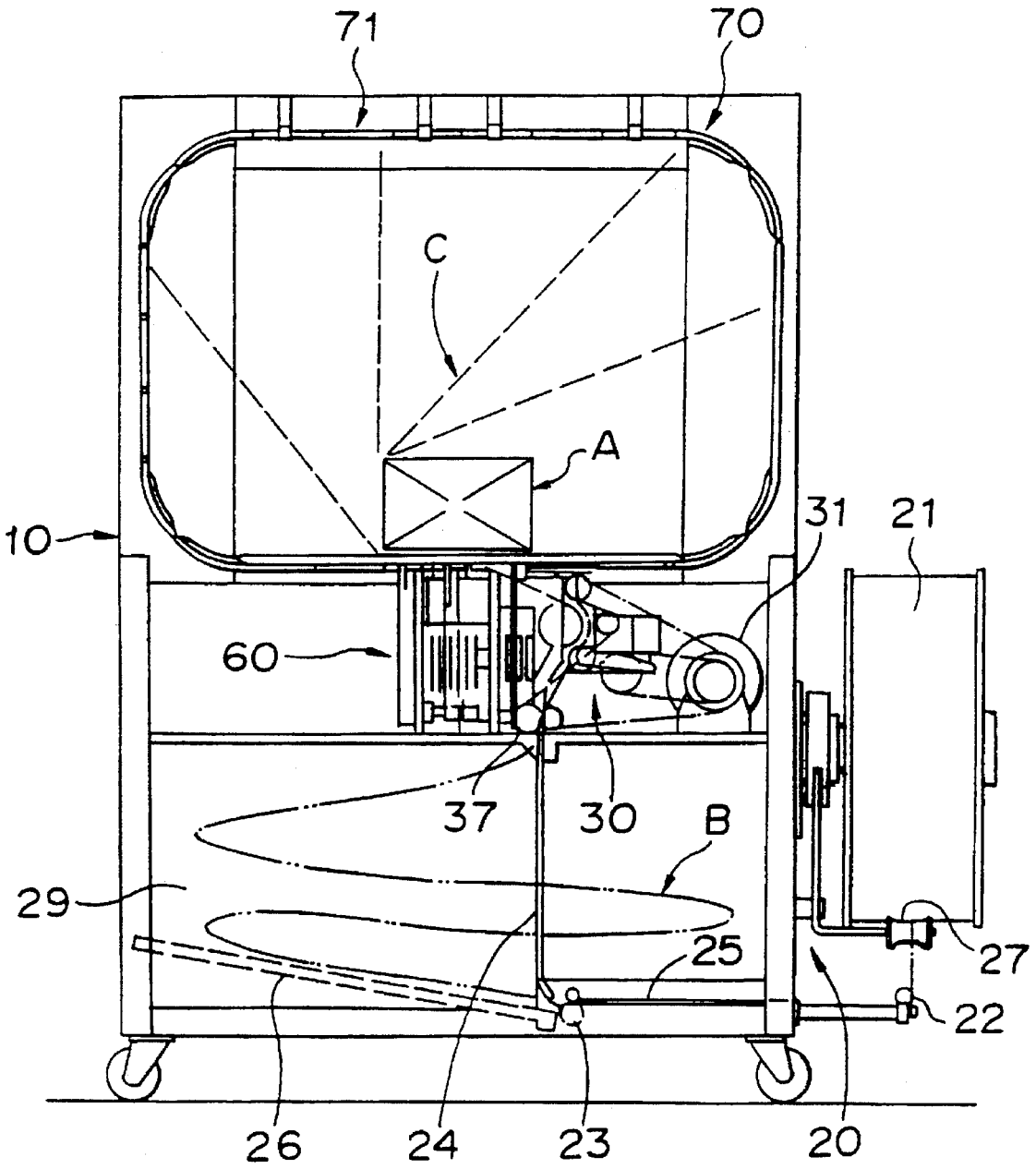
FIG. 1 is a front view showing an arch type strapping machine according to the present invention.
Figure 2:
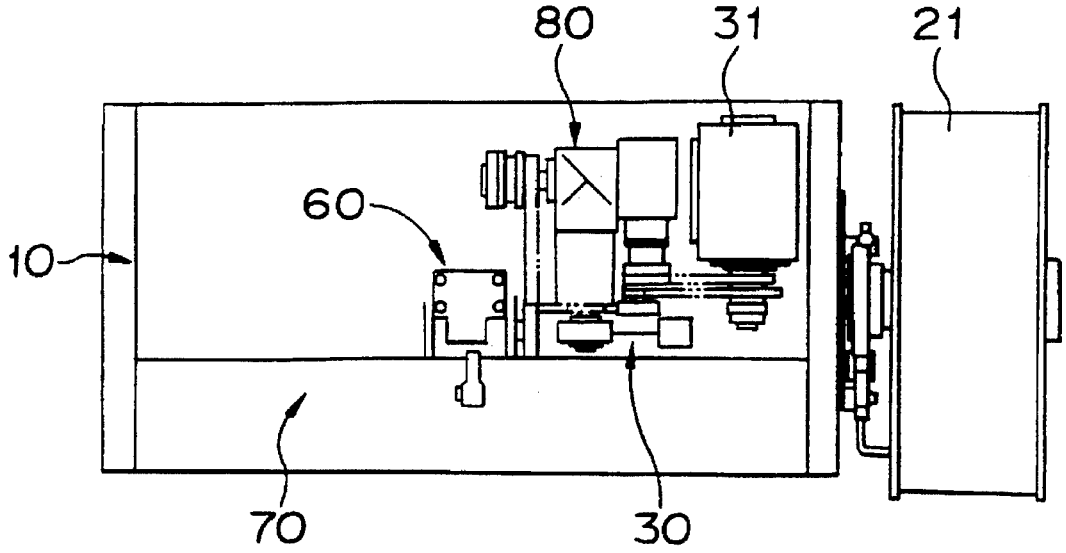
FIG. 2 is a plan view showing the strapping machine of FIG. 1.

In FIG. 1, the main body 10 of the strapping machine according to the present invention generally comprises a band feeding unit 20, a roller unit 30, a seal unit 60, an arch unit 70 and a driving force transmission means 80.

The band feeding unit 20 has a band reel 21. A band wound around the band reel 21 is supplied to the roller unit 30 through a guide roller 22, a guide 25, an auxiliary feeding unit comprising a pair of rollers 23 and a guide 24.

Further, the band feeding unit 20 has a chamber 29 in a lower portion of the main body 10. The chamber 29 provides a smooth supply of band by temporarily accumulating the band which is to be fed to a binding portion at a high speed for packaging and receives a retracted portion of the band when the band is subjected to a tightening operation.

A band accumulation sensor 26 is disposed in the chamber 29 so that a predetermined amount of the band is always stored in the chamber 29. An amount of accumulation of the band is detected depending on a position of the band accumulation sensor 26. Thus, a supply of the band from the band reel 21 to the chamber is controlled.

Figure 3:
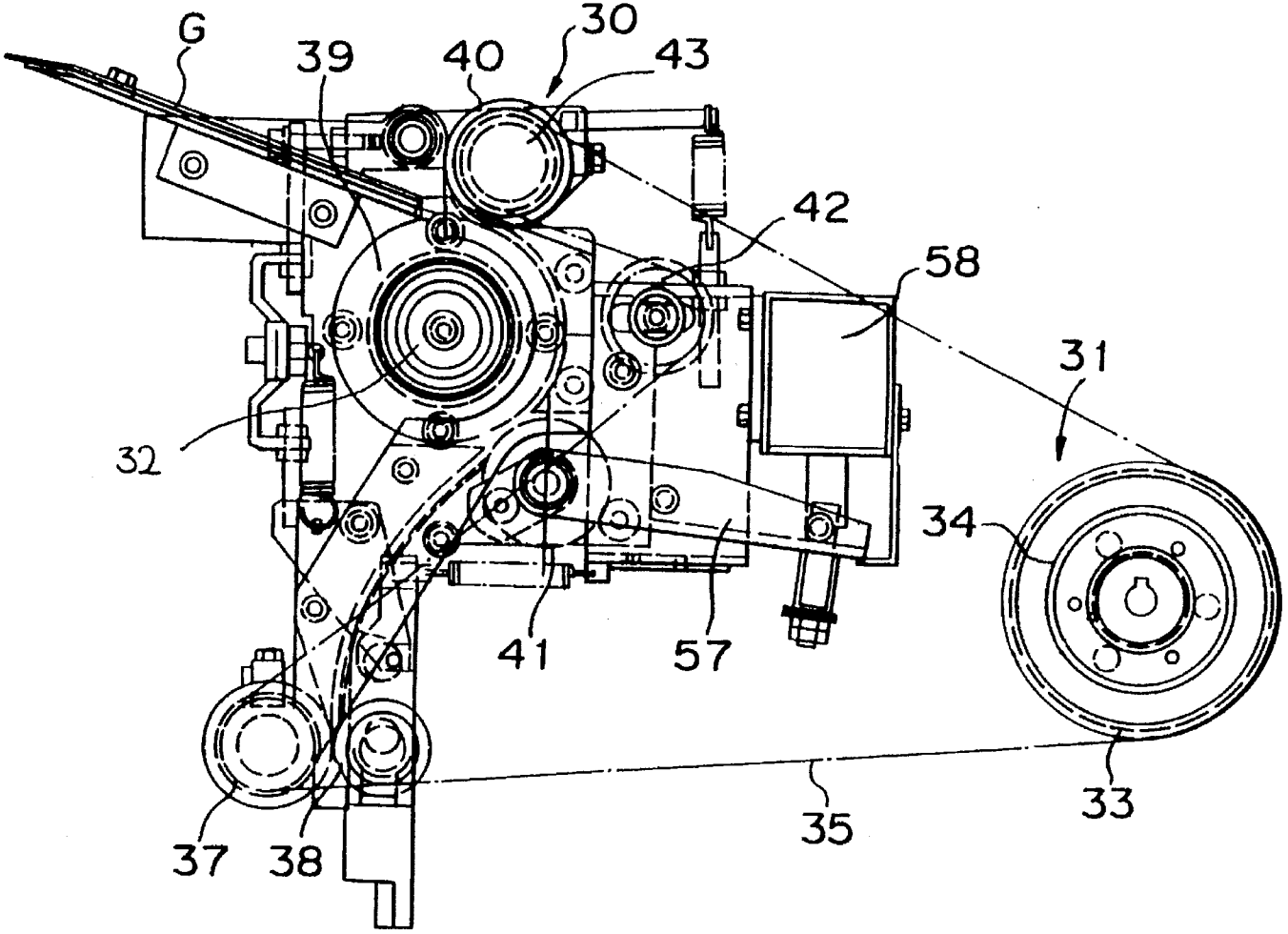
FIG. 3 is an enlarged front view showing a roller unit of the strapping machine of FIG. 1.

In FIG. 3, the roller unit 30 has a group of rollers such as the pair of feeding rollers 37, 38, a high-speed return roller 40 and a tension roller 42 which are driven via a belt 35 coupled to a large diameter pulley 33 fixed to the shaft of a motor 31, a return roller 39 which is independently driven by the motor 31 through a speed reduction gear 81 and a one-way clutch 32, and a secondary tightening rocker roller 41 facing the return roller 39 in order to strongly tighten the band.

Figure 7:
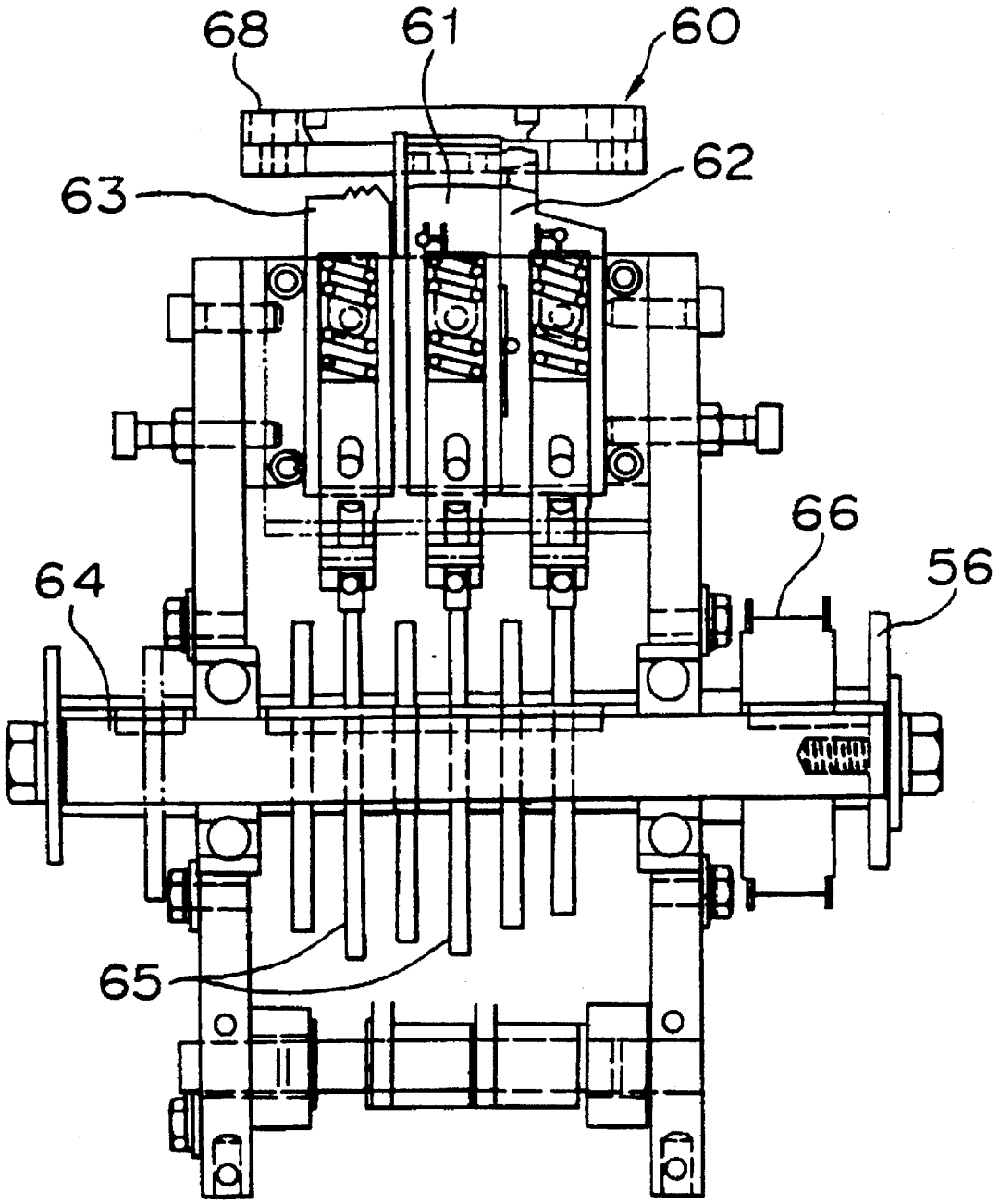
FIG. 7 is a front view showing a seal unit of the strapping machine of FIG. 1.

As specifically shown in FIG. 7, the seal unit 60 is to fix the top end of the band which has been wound around an article A to be packed, to bind the band tightened by means of heat bonding or the like and to cut the band. The seal unit comprise a sealing portion composed of a compression head 61, grippers 62, 63 and operating cams 65, a camshaft 64, a camshaft driving pulley 66 and so on which operate the sealing unit.

Beneath an anvil 68, there are located the compression head 61 and left and right grippers 62, 63 which are moved vertically by the cams 65 whereby operations such as binding of the band, tightening the articles to be packed and heat bonding of the band are performed. A cam for timing roller 56 can be provided on the camshaft 64. A pulley 66 is fixed to the camshaft 64. The pulley 66 is coupled by means of a drive belt to a pulley 86 fixed to the output shaft 84 for driving the camshaft of the speed reduction gear 81 shown in FIG. 6.

The roller unit 30 which constitutes a main component of the present invention will now be described. It is preferable to have such structure that the return roller 39 is applied with driving power through the one-way clutch 32 attached to the output shaft of the speed reduction gear 81 which receives the driving power via a drive belt from a small diameter pulley 34 fixed to the motor 31.

As clearly shown in FIG. 3 which shows the main part of an embodiment of the present invention, the high-speed return roller 40 is located above the return roller 39 which is unidirectionally rotatable by the one-way clutch 32, namely the high-speed return roller 40 is located in the vicinity of a contact point of a guide G and the return roller 39.

On the other hand, the secondary tightening rocker roller 41 is preferably located below the return roller, for example, at a position of 90° through 120° (degrees) in the clockwise direction from the contact point between the high-speed return roller 40 and the return roller 39.

The relationship between the rollers and the band B is as follows:

In an initial stage that the band is wound around the article to be packed A, the top end of the band supplied at a high speed from the chamber 29 is fed through the pair of the feeding rollers 37, 38, the guide G, the groove of the band guide 71 in the arch unit 70 so as to wind around the article to be packed A and arrives at the position of the gripper 62 in the seal unit 60. When the top end of the band is fixed, the pair of the feeding rollers 37, 38 are separated from each other and the high-speed return roller 40 is pushed to the surface of the return roller 39. In this case, the return roller 39 is rotated constantly at a low speed in the clockwise direction in FIG. 3 through the one-way clutch 32 attached to the driving shaft of the speed reduction gear 81. Then, the high-speed return roller 40 is pushed to the return roller 39. The return roller 39 is freely accelerated to the same speed as the high-speed return roller 40 since the return roller 39 is fixed to the driving shaft by interposing the one-way clutch (not shown) between them. Thus, the first tightening can be quickly performed by pulling back the band by the return roller 39. Thus, the band B is pulled back to tighten the article to be packed. Thereafter, the high-speed return roller 40 is separated from the return roller 39. Simultaneously, the secondary tightening rocker roller 41 is pushed to a lower portion of the return roller by an arm 57 moved by of a solenoid 58. Accordingly, the band is applied with a secondary strong tightening force since the band is caught between the return roller 39 having a large torque at a low speed and the rocker roller 41.

Since the rocker roller 41 is located 90° through 120° (degrees) apart from the contact point of the high-speed return roller 40 which is near a tangent point between the band and the return roller 39, the band is tightened in a state that the band is wound on the periphery of the return roller by at least one fourth of the periphery. As a result, a frictional force between the return roller 39 of large torque and low speed and the band is very large.

Since the high-speed return roller 40 is located on the upper portion of the return roller which is near the tangent point between the return roller and the band, the friction between the band and the return roller at the termination of a high speed revolution for the first tightening is small. Thus, the inertia force of the return roller does not affect the band.

In another embodiment of the present invention, an electromagnetic clutch may be used to connect the high-speed return roller 40 to the driving shaft. In this case, at the time of the high-speed pulling back for the first tightening, the high-speed return roller 40 is brought to contact with the return roller 39 since the electromagnetic clutch is in an ON state. The return roller having the one-way clutch is turned clockwise at a high-speed to pull back the band at a high speed in the first tightening. Then, the electromagnetic clutch is rendered to be in an OFF state but the high-speed return roller 40 is continuously made to contact with the return roller 39. At the same time, the rocker roller 41 contacts the return roller 39. Then the band receives the secondary strong tightening in accordance with the rotation of the return roller at a low speed with a large torque.

In this case, also, the high-speed return roller is maintained in contact with the return roller. Therefore, the high-speed return roller 40 is turned freely in accordance with the low-speed rotation of the return roller 39. Accordingly, the band can be guided without separation from the return roller, and there is no adverse effect on the turning of the return roller.

As another embodiment of the present invention wherein the high-speed return roller 40 and the band-feeding roller 37 are driven by a single belt 35, the high-speed return roller 40 and the band-feeding roller 37 can be so constituted that levers 53, 46 which support the high-speed return roller 40 and the band-feeding roller 37 respectively are turned in a synchronous manner by a cam for timing roller 56 provided on the camshaft 64.

Figure 4:
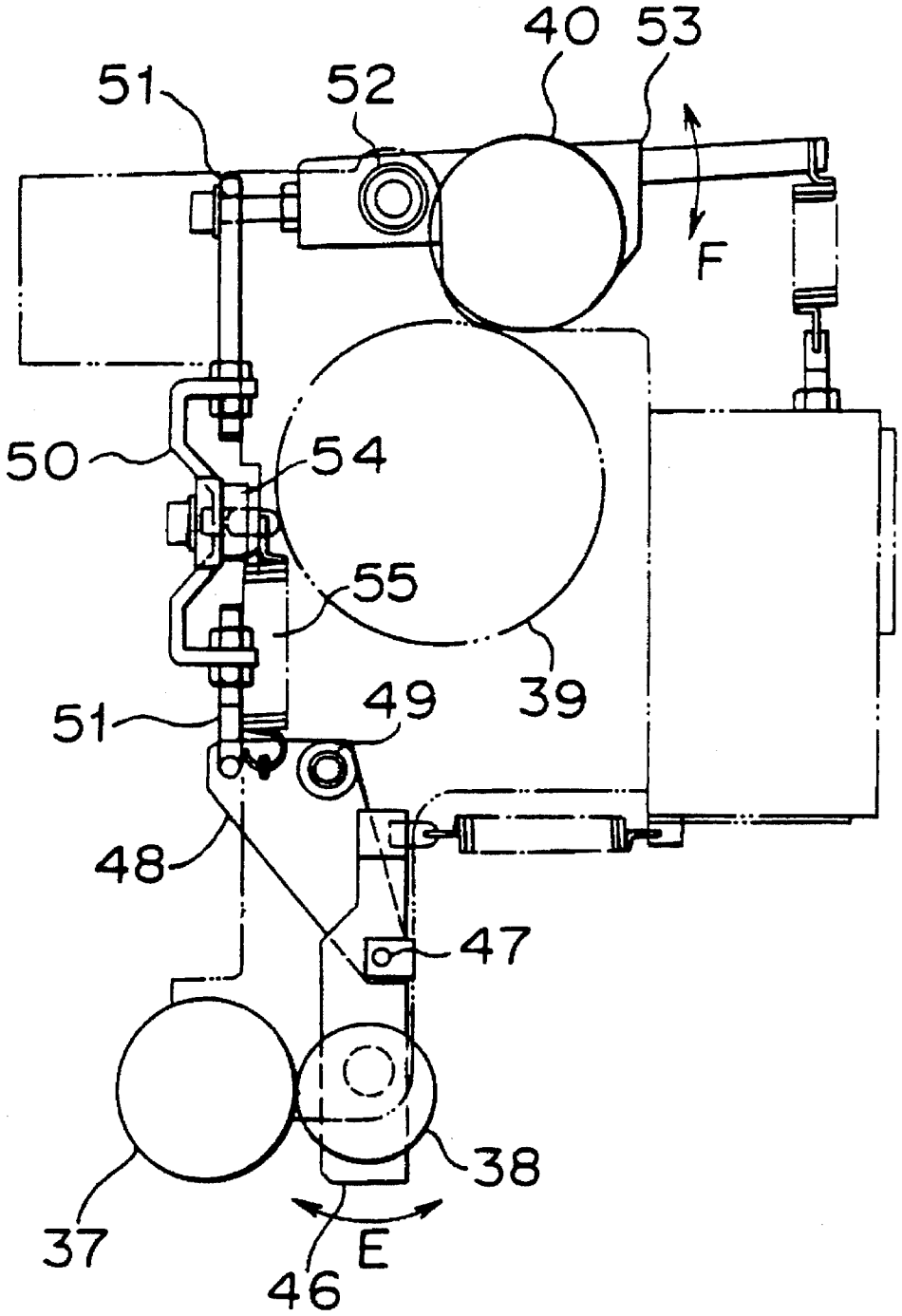
FIG. 4 is a partly omitted enlarged front view showing the roller unit of FIG. 3 which shows that a rocker roller for feeding and a roller for high speed pulling are alternatively driven in a synchronous manner.
Figure 5:
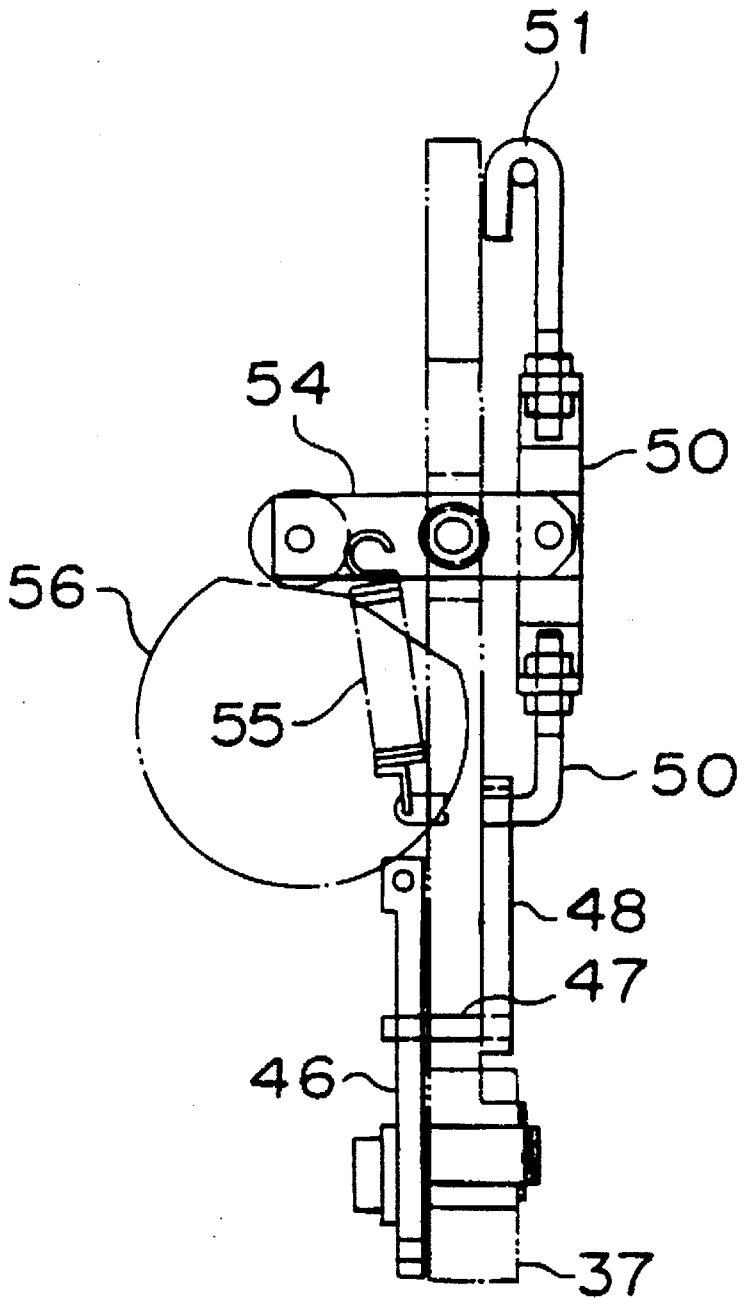
FIG. 5 is a partly omitted enlarged front view of FIG. 4 showing a synchronously driving mechanism and a cam for controlling the mechanism.

The above-mentioned mechanism is explicitly shown in FIGS. 4 and 5. In FIG. 4, the high-speed return roller 40 which detachably contacts the return roller 39 is supported by the roller driving lever 53. The roller driving lever 53 is swung in the directions of arrow F around a pivot 52. On the other hand, a rocker roller 38 as one of the paired band feeding rollers is pivotally connected to a lever 46 which is moved by a pin 47 fixed to a swingable plate 48. The lever 53 and the swingable plate 48 connected to the lever 46 are connected to a swing transmitting member 50 via hooks 51, 51.

The swing transmitting member 50 is pivotally connected at its intermediate portion to a swing arm 54. A roller fixed at an end of the swing arm 54 is engaged with the cam for timing roller 56 fixed to the camshaft 64.

Accordingly, the swing transmitting member 50 is moved in the vertical direction with rotation of the cam for timing roller 56 via the swing arm 54. In synchronism with this movement, the return roller 39 is pushed to contact with the high-speed return roller 40, and the rocker roller 38 separates from or contacts with the roller 37. Such movements are effected repeatedly. Thus, the synchronous contact and separation can easily be attained only by the rotation of the cam.

FIG. 7 is a schematic view of the sealing unit. Below the anvil 68, operations such as fixing of the band, a tightening of the article to be packed and melt bonding of the band are performed by the vertical movements of the compression head 61 and the left and right grippers 62, 63 by a plurality of cams 65 respectively. Also, the cam for timing roller 56 can be attached to the camshaft 64. Reference 66 designates the pulley fixed to the camshaft 64, and the belt is engaged with the pulley fixed to the output shaft of the speed reduction gear 81 which drives the camshaft 84.

Next, the mechanism of transmitting the driving force which is a characteristic feature of the present invention is explained in detail.

In FIG. 3, the large diameter pulley 33 driven by the motor 31 drives the feeding roller 37, the tension roller 42 and the high-speed return roller 40 via the belt. On the other hand, a small diameter pulley 34 is coupled with a pulley 85 fixed to the input shaft 82 of the speed reduction gear 81 by a belt to thereby drive the pulley 85.

Figure 6:
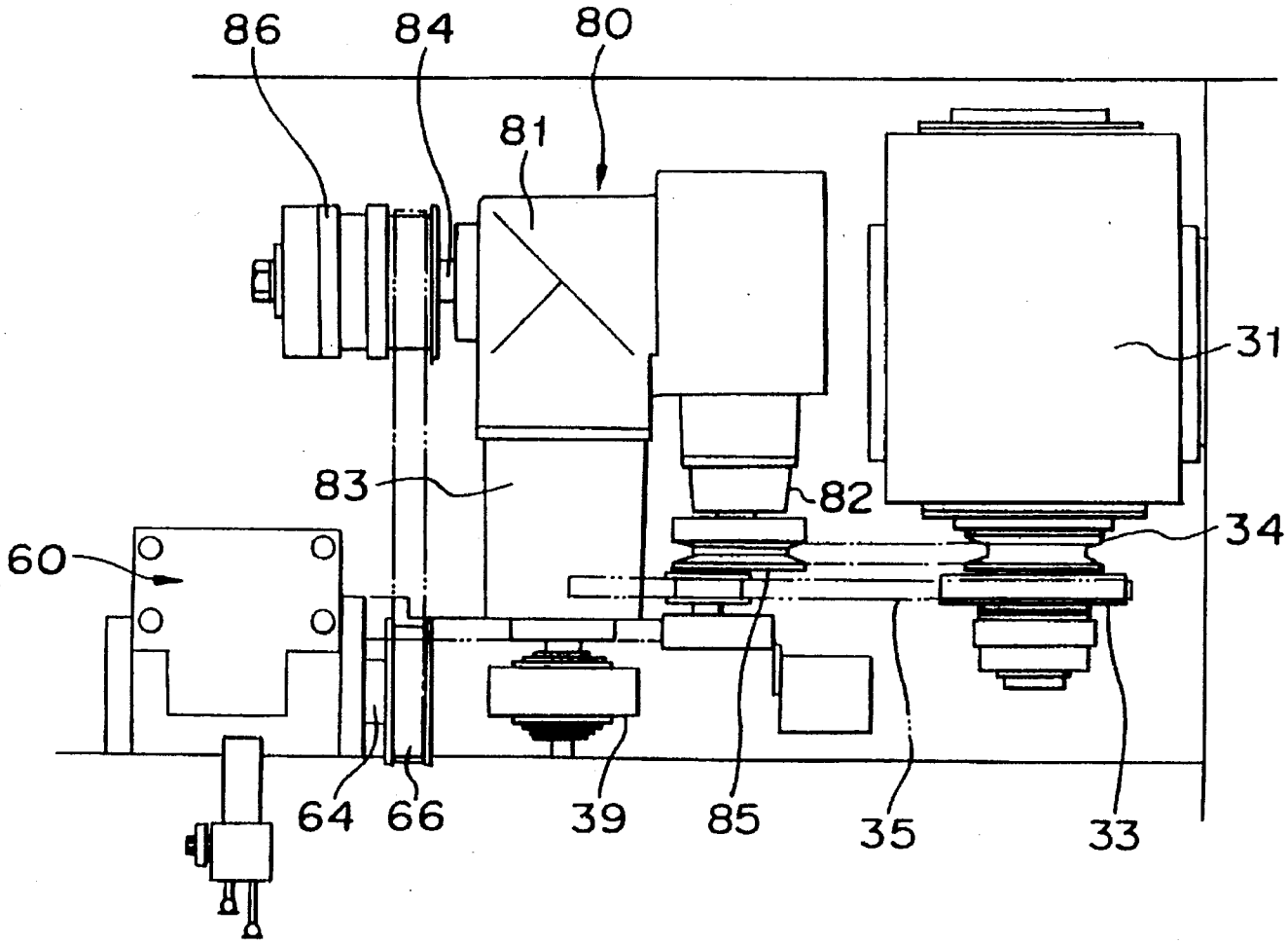
FIG. 6 is a plan view showing the strapping machine of FIG. 1 according to the present invention.
Figure 8:
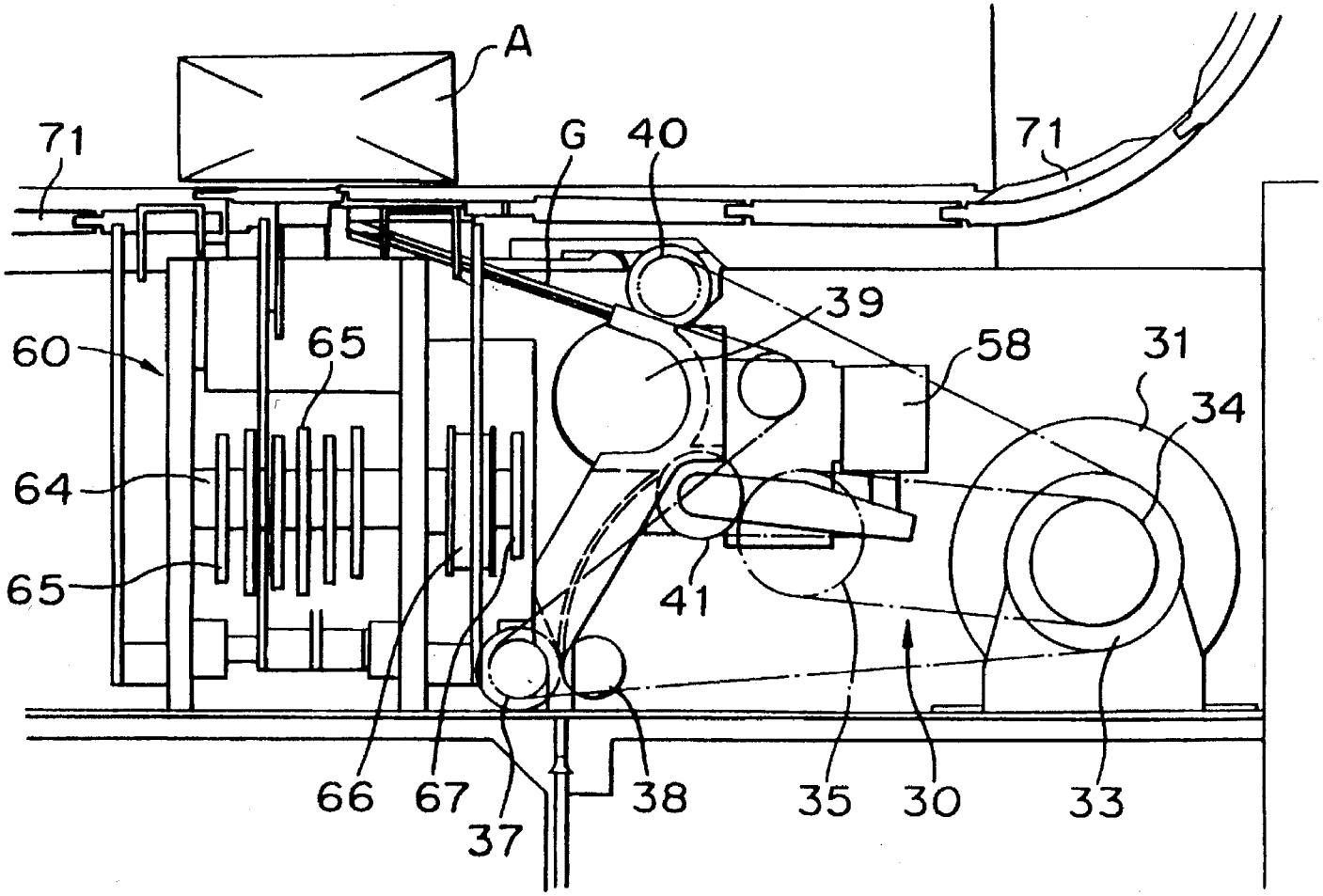
FIG. 8 is an enlarged front view showing a cam unit for driving the roller unit and the seal unit of the strapping machine of FIG. 1.
Figure 9:
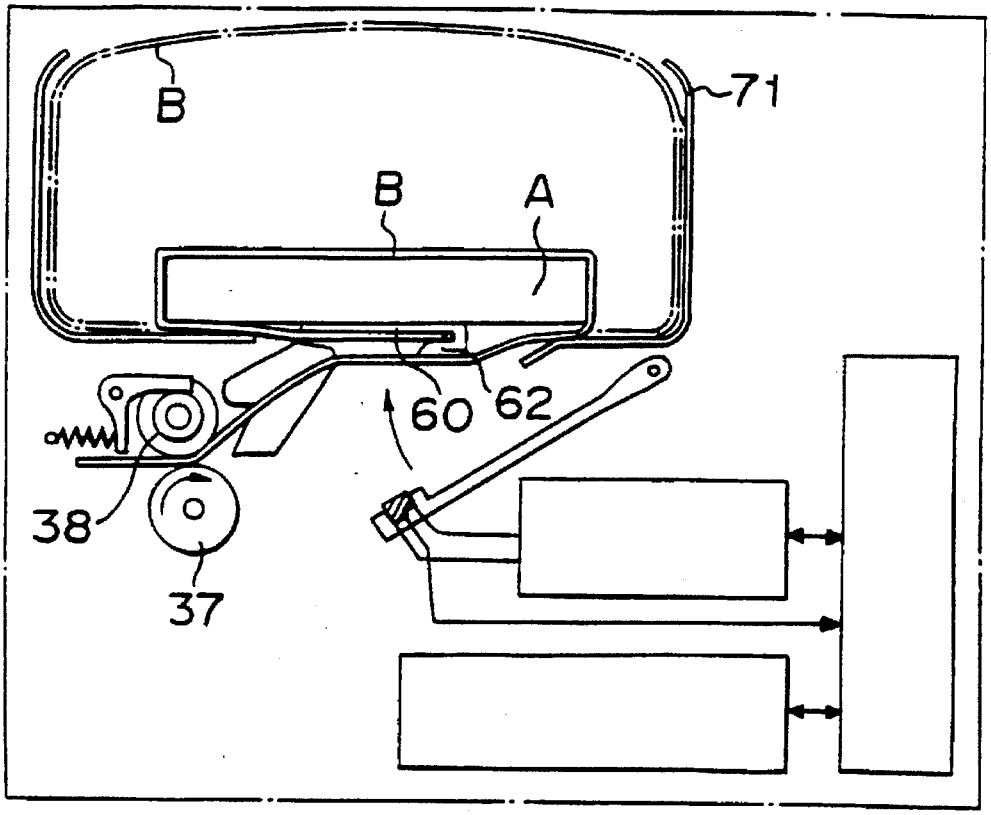
FIGURE 9 PRIOR ART
FIG. 9 is a front view for schematically showing a roller for feeding a band and a controlling unit for band control according to a conventional technique.
Figure 10:
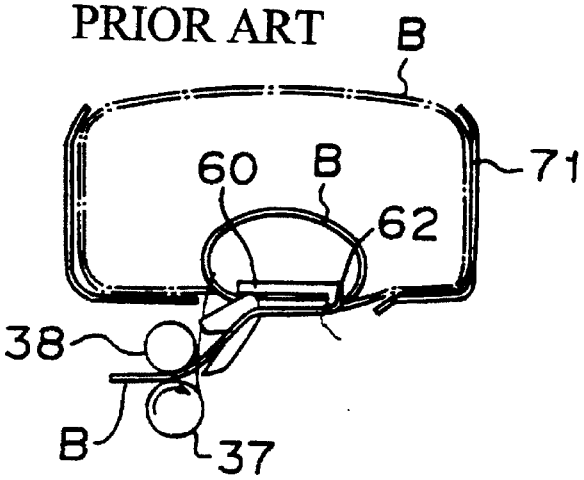
FIGURE 10 PRIOR ART
FIG. 10 is a front view for schematically showing a band feeding and pulling back operation according to the conventional technique.

In another embodiment of the present invention shown in FIGS. 6 and 8, the motor 31 having the output shaft which extends in perpendicular to the arch unit 70 and a speed reduction unit 80 having the output shaft which extends perpendicular to the arch unit 70 are mounted in a parallel relation on a frame of the main body 10. As mentioned in the above, the pulley 34 and the pulley 85 are coupled with the band. The speed reduction unit 80 comprises an orthogonally crossing biaxial type speed reduction gear 81 having two output shafts 83, 84 which cross perpendicularly as shown in FIG. 6.

The return roller 39 is directly fixed via the one-way clutch to one of the output shafts, namely the output shaft 83 which is parallel to the input shaft 82. The pulley 86 is fixed to the other output shaft, namely the output shaft 84 crosses perpendicular to the input shaft 82 and extends parallel to the arch unit 70. The pulley 86 and the pulley 66 fixed to the camshaft 64 parallel to the output shaft 84 are coupled with the belt.

It should be noted that in an arch type strapping machine wherein a band is tightened around an article to be packed, the size of the main body tends to be large in the lateral direction of the main body, namely in the direction of the arch unit, because of the structure of a band guide. However, the width of the main body in the direction perpendicular to the arch unit, namely depth direction is preferably minimized.

When the driving mechanism of the present invention is utilized, the positions and the directions of the motor and the seal unit can be rationally determined, whereby the position and the direction of the shaft for driving the seal cam can be efficient; the width of the main body of the strapping machine in its depth direction can be made small; and a means for driving the roller unit for feeding the band and a means for driving the camshaft of the seal unit for a band binding treatment can be driven with a single motor. Accordingly, in consideration of a suitable arrangement of the driving mechanism, the mechanism of the present invention is very useful for the compactness of the strapping machine, the reduction in the number of the components, and reducing cost.

In accordance with a primary advantage of the present invention, generation of an undesired friction force on the return roller, which is caused when the band is extended on the return roller with a large wrapping angle at the time of the high speed returning and just after the returning of the band, can be prevented since the high-speed return roller is located at a higher position of the return roller. Accordingly, when the band has been pulled back at high speed, the return roller does not generate a further tensile impact force to the pulled back band by the inertia of the return roller in the high speed rotation.

The secondary advantage of the present invention is that a sufficient tightening force is obtainable at the time of the secondary tightening since the rocker roller (secondary tightening rocker roller 41) is located below the return roller separate from the high-speed return roller 40, and accordingly, a wrapping angle of the band to the return roller is large.

The third advantage of the present invention is that looseness of the band at the time of transition between the first tightening and the secondary tightening is prevented since the high-speed return roller 40 is pushed to contact the return roller 39 until the secondary tightening by driving the high-speed return roller via the electromagnetic clutch. Thus, the drawbacks of the conventional technique such as a large-sized motor and a waste of electricity, which are caused by energy loss in continuous forcible contact of the high-speed return roller to the return roller while allowing the slippage of the band in order to prevent the looseness of the band, can be prevented.

The fourth advantage of the present invention is that costs can be reduced and power consumption can be saved by adopting a simple structure and by avoiding the necessity of providing respective solenoids for controlling the forcible contact since the swing transmitting member is controlled by the single cam to contact with or separate from the high-speed return roller and the rocker roller for feeding the band when the rollers are driven by the single belt.

The fifth advantage of the present invention is that, in the strapping machine having the structure such that the direction of each axis of the rollers for operating the band and the direction of the axis of the camshaft for driving the seal unit cross perpendicularly, the dimensions in the depth direction of the frame can be reduced to achieve miniaturization effectively since the perpendicularly crossing axes are driven by the single motor.

Obviously, numerous modifications and variations of the present invention are possible in light of the above teachings. It is therefore to be understood that within the scope of the appended claims, the invention may be practiced otherwise than as specifically described herein.

What is claimed is:

1. A strapping machine, which comprises:

a band feeding unit, a roller unit for feeding and tightening a band fed from the band feeding unit, a seal unit securing the band on an article to be packed, an arch unit; and a driving force transmission mechanism, wherein the roller unit comprises a pair of band feeding rollers for feeding the band to the arch unit; a first, high-speed, small torque return roller for tightening the band firstly; a second, large torque, low-speed return roller for tightening the band secondly, wherein the first return roller selectively contacts with and separates from the second return roller; and a secondary tightening rocker roller selectively contacting with and separating from the second return roller, wherein the band is windable around the article to be packed by feeding the band to a band guide positioned in the arch unit by the pair of band feeding rollers;

the seal unit includes an anvil and gripper which hold a top end of the band;

the first return roller is movable to contact the second return roller and to cause a first tightening of the band at high speed around the article to be packed; and after the first tightening has been finished, the first return roller is separated from the second return roller and simultaneously the rocker roller is pushed to contact the second return roller to cause a secondary tightening of the band around the article which is more forcible.

2. A strapping machine according to claim 1, which comprises:

a single belt driving the first return roller and one of the band feeding rollers;

levers which respectively support the first return roller and the rocker roller in a swingable manner; and the seal unit includes a camshaft having cams fixed thereto, said cams simultaneously swinging the levers.

3. A strapping machine which comprises:

a band feeding unit, a roller unit for feeding and tightening a band fed from the band feeding unit, a seal unit securing the band on an article to be packed, an arch unit; and a driving force transmission mechanism, wherein the roller unit comprises a pair of band feeding rollers for feeding the band to the arch unit; a first, high speed, small torque return roller for tightening the band firstly; a second, large torque, low speed return roller for tightening the band secondly, wherein the first return roller selectively contacts with and separates from the second return roller; and a secondary tightening rocker roller selectively contacting with and separating from the second return roller, and a motor and an electromagnetic clutch wherein the high-speed return roller is connected to said motor via said electromagnetic clutch;

the band being wound around the article to be packed by feeding the band to a band guide positioned in the arch unit by the pair of band feeding rollers wherein the seal unit includes an anvil and gripper which hold a top end of the band;

the first return roller is contacted with the second return roller during the first tightening;

after the first tightening has been completed, the electromagnetic clutch is released while the first return roller is separated from the second return roller; and the rocker roller is contacted with the second return roller to cause the secondary tightening and the secondary tightening is more forceful than the first tightening of the band around the article.

4. A strapping machine according to claim 3, which comprises:

a single belt driving the first return roller and one of the band feeding rollers;

levers which respectively support the first return roller and the rocker roller in a swingable manner; and the seal unit includes a camshaft having a cam fixed thereto, said cams simultaneously swinging the respective levers.

5. A strapping machine, which comprises:

a band feeding unit, a roller unit for feeding and tightening a band fed from the band feeding unit, a seal unit to secure the band on an article to be packed, an arch unit within which the article is placed;

a driving force transmission mechanism; and a camshaft driving the seal unit, said camshaft being oriented parallel with the arch unit; wherein the roller unit comprises a pair of band feeding rollers for feeding the band to the arch unit; a first, high-speed, small torque return roller; a second, large torque, low speed return roller; said first return roller selectively contacting with the second return roller and tightening the band firstly; and a tightening rocker roller selectively contacting with the second return roller and tightening the band secondly;

at least one of said return rollers has a drive shaft which is oriented perpendicular to the arch unit; and the transmission mechanism includes a motor and a speed reduction gear wherein the camshaft driving the seal unit and the drive shaft of the return roller cross perpendicularly to each other and are coupled to the motor via said speed reduction gear and said speed reduction gear having first and second output shafts which are perpendicular to one another.

* * * * *